US011130649B2

(12) United States Patent
Okada

(10) Patent No.: US 11,130,649 B2
(45) Date of Patent: Sep. 28, 2021

(54) SHEET DISCHARGE DEVICE

(71) Applicant: KYOCERA Document Solutions Inc., Osaka (JP)

(72) Inventor: Takehiko Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 137 days.

(21) Appl. No.: 16/781,942

(22) Filed: Feb. 4, 2020

(65) Prior Publication Data

US 2020/0290838 A1 Sep. 17, 2020

(30) Foreign Application Priority Data

Mar. 13, 2019 (JP) ..... JP2019-046352

(51) Int. Cl.
*B65H 31/02* (2006.01)
*B65H 31/20* (2006.01)

(52) U.S. Cl.
CPC ..... *B65H 31/02* (2013.01); *B65H 31/20* (2013.01); *B65H 2301/4212* (2013.01); *B65H 2401/213* (2013.01); *B65H 2402/545* (2013.01); *B65H 2405/1122* (2013.01); *B65H 2405/1124* (2013.01); *B65H 2405/3321* (2013.01); *B65H 2511/11* (2013.01); *B65H 2801/39* (2013.01)

(58) Field of Classification Search
CPC .. B65H 31/02; B65H 2401/213; B65H 31/20; B65H 2405/1122; B65H 2405/1142; B65H 2405/11425; B65H 2511/11; B65H 2511/12
USPC ..... 271/223, 224
See application file for complete search history.

(56) References Cited

U.S. PATENT DOCUMENTS 5,215,301 A * 6/1993 Oshino ..... B65H 31/08 271/176
8,807,557 B2 * 8/2014 Lu ..... B65H 1/04 271/171
2021/0061592 A1 * 3/2021 Ikeda ..... B65H 31/08

FOREIGN PATENT DOCUMENTS

JP 2008-199295 A 8/2008
JP 2010-023932 A 2/2010

* cited by examiner

*Primary Examiner* — Jeremy R Severson
(74) *Attorney, Agent, or Firm* — Studebaker & Brackett PC

(57) ABSTRACT

A sheet discharge device includes a discharge member, a discharge tray and a stopper. The discharge tray includes a groove and a fixed magnetic body. The groove is formed along a discharge direction. The fixed magnetic body is disposed at a predetermined position along the groove. The stopper includes a guide piece, a contact piece and a moving magnet body. The guide piece is engaged with the groove in a slidable manner. With the contact piece, the leading edge of the sheet is allowed to be come into contact. The moving magnetic body generates a magnetic force in a direction in which the moving magnetic body and the fixed magnetic body are attracted each other. When the guide piece is slid along the groove and the moving magnetic body reaches the predetermined position, a resistance is applied to a sliding movement of the guide piece by the magnetic force.

7 Claims, 5 Drawing Sheets

SHEET DISCHARGE DEVICE

INCORPORATION BY REFERENCE

This application is based on and claims the benefit of priority from Japanese patent application No. 2019-046352 filed on Mar. 13, 2019, which is incorporated by reference in its entirety.

BACKGROUND

The present disclosure relates to a sheet discharge device which feeds a sheet, such as a document feeding device.

A document feeding device is sometimes provided with a discharge member which discharges a document (a sheet) whose image has been read and a discharge tray on which the discharged sheet is stacked. In some cases, a stopper with which the leading edge of the sheet stacked on the discharge tray comes into contact is also provided. The stopper prevents the sheet from jumping out of the discharge tray and allows the leading edge of the sheet to be aligned.

Some of an image reading device is provided with a document stopper (the stopper) movable in the discharge direction according to a size of the document. Alternatively, some of a sheet discharge tray includes an extension tray drawable in the discharge direction, and the sheet contact part of the stopper portion (the stopper) of the extension tray is formed to be protruded upstream in the sheet discharge direction.

However, because the above stoppers are fixed in almost a perpendicular posture, they may interfere with the discharged documents when the documents are taken out, and there is a problem that it is difficult to take out the documents. Additionally, in a case of the type of drawing the stopper manually, it is necessary to position the stopper according to a size of the document, but there is a problem that it is difficult to position the stopper at a suitable position.

SUMMARY

In accordance with an aspect of the present disclosure, a sheet discharge device includes a discharge member, a discharge tray and a stopper. The discharge member discharges a sheet in a predetermined discharge direction. On the discharge tray, the sheet discharged by the discharge member is stacked. The stopper regulates a leading edge of the sheet stacked on the discharge tray. The discharge tray includes a groove and a fixed magnetic body. The groove is formed along the discharge direction. The fixed magnetic body is disposed at a predetermined position along the groove. The stopper includes a guide piece, a contact piece and a moving magnet body. The guide piece is engaged with the groove in a slidable manner. With the contact piece, the leading edge of the sheet discharged by the discharge member is allowed to be come into contact. The moving magnetic body generates a magnetic force in a direction in which the moving magnetic body and the fixed magnetic body are attracted each other. When the guide piece is slid along the groove and the moving magnetic body reaches the predetermined position, a resistance is applied to a sliding movement of the guide piece by the magnetic force generated between the fixed magnetic body and the moving magnetic body.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a sheet discharge device according to one embodiment of the present disclosure will be described with reference to the drawings.

Figure 1:
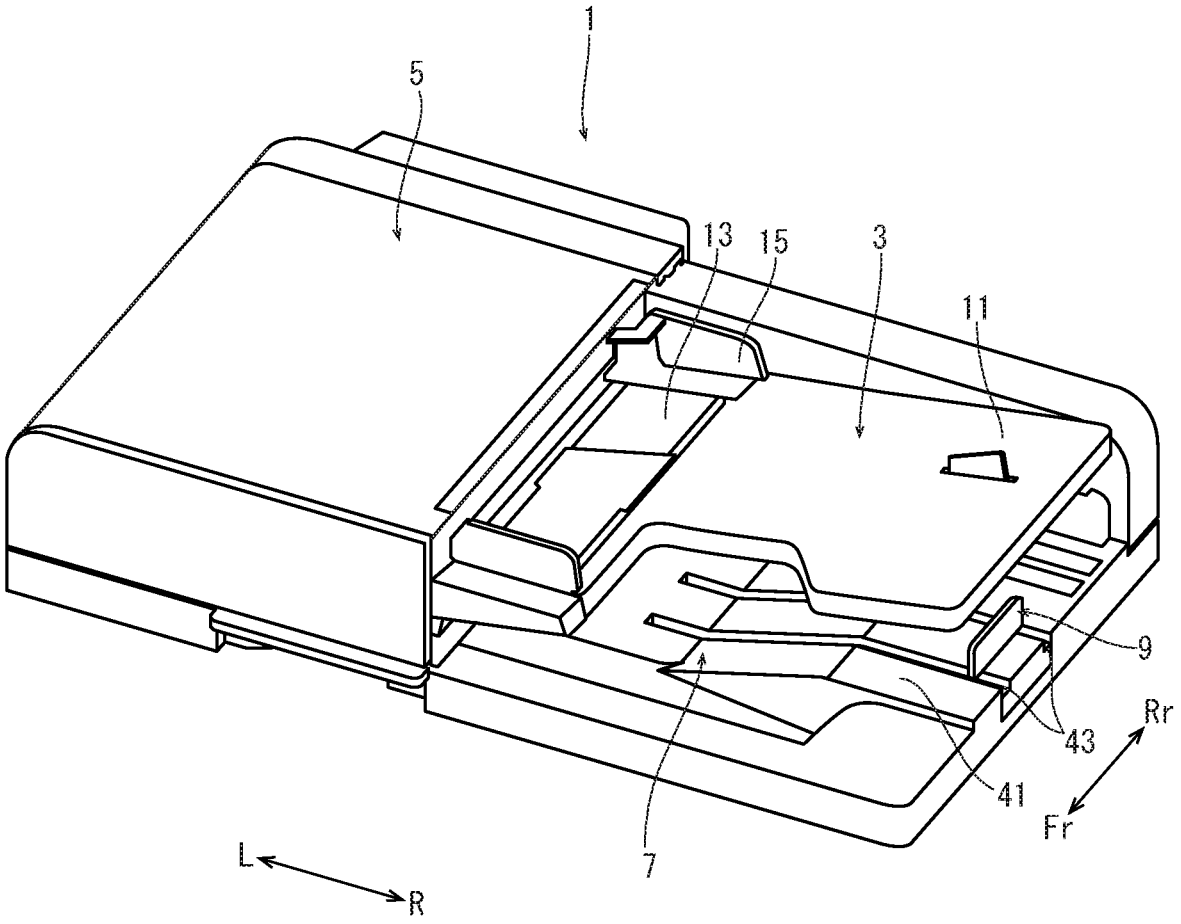
FIG. 1 is a perspective view showing a document feeding device according to one embodiment of the present disclosure.
Figure 2:
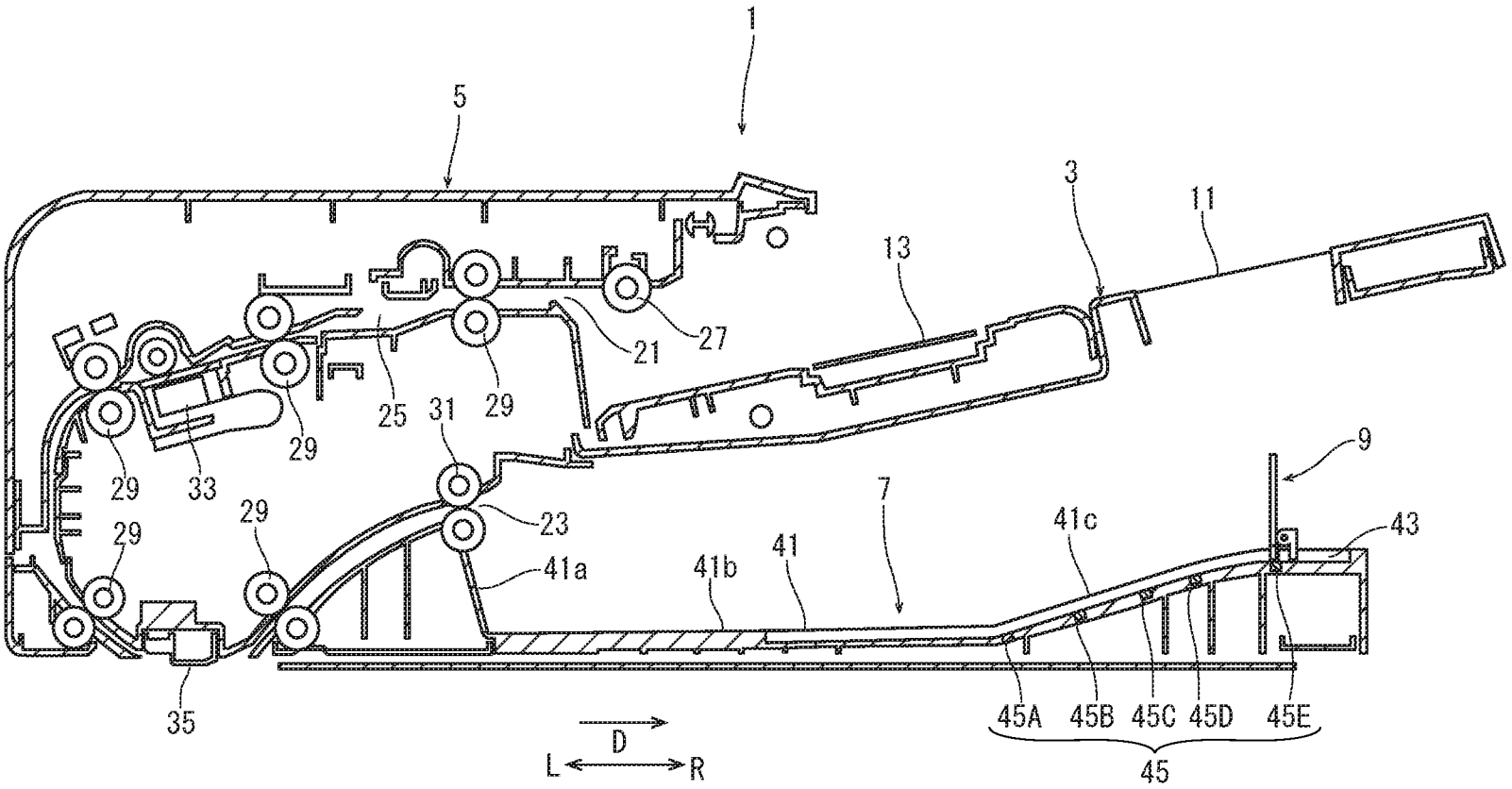
FIG. 2 is a sectional view showing the document feeding device according to the embodiment of the present disclosure.
Figure 3:
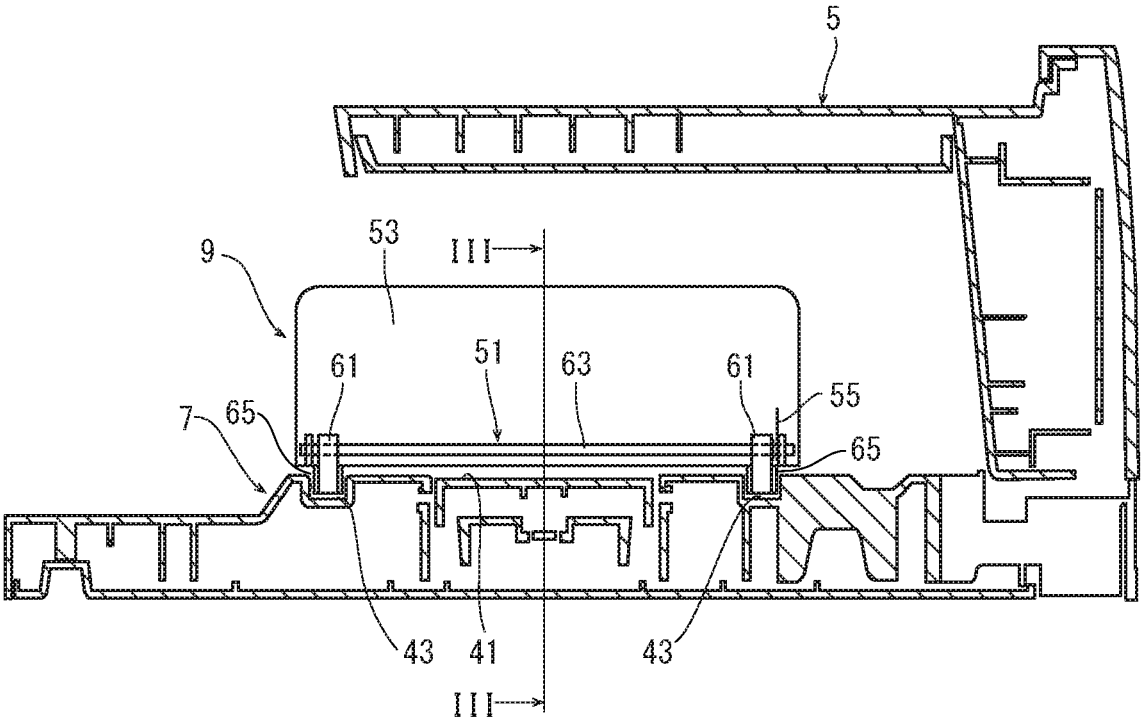
FIG. 3 is a sectional view showing the document feeding device according to the embodiment of the present disclosure.

With reference to FIG. 1 to FIG. 3, an entire structure of a document feeding device as a sheet discharge device will be described. FIG. 1 is a perspective view showing the document feeding device, and FIG. 2 and FIG. 3 are sectional views showing the document feeding device. In each figure, Fr, Rr, L and R respectively show a front side, a rear side, a left side and a right side of the document feeding device 1.

The document feeding device includes a document table 3 on which a document S (a sheet) is placed, a conveyance part 5 which conveys the document S placed on the document table 3 and then discharges it, a discharge tray 7 on which the document S discharged from the conveyance part 5 is stacked and a stopper 9 which regulates the leading edge of the document S stacked on the discharge tray 7.

The document table 3 has a size allowing for the document S to be placed, and has a document placement part 11, on which the document S is placed, on the upper face. On the upper face of the document placement part 11 on a side of the conveyance part 5, a lift plate 13 is supported in a turnable manner. The lift plate 13 is turnable in the upper-and-lower direction around the end portion opposite to a side of the conveyance part 5. When the lift plate 13 is turned upwardly, the leading end portion (the end portion on a side of the conveyance part 5) of the document S placed on the document placement part 11 is lifted. On the lift plate 13, a pair of side cursors 15 to align the document S in the width direction of the document S is supported in a slidable manner along the width direction.

As shown in FIG. 2, the conveyance part 5 includes a receiving port 21 for the document S, a discharge port 23 for the document S, a conveyance path 25 provided between the receiving port 21 and the discharge port 23, a feeding roller 27 and a plurality of conveyance rollers pairs 29 and a discharge rollers pair 31 as a discharge member, provided along the conveyance path 25.

The receiving port 21 is formed along the width direction of the document S. Below the receiving port 21, the document table 3 is attached in a posture inclined downwardly toward the conveyance part 5. Below the document table 3, the discharge port 23 is formed along the width direction of the document S. The conveyance path 25 is formed so as to extend leftward from the receiving port 2, curve downward and then extend rightward to the discharge port 23. On the middle of the conveyance path 25, a detection part 33 to detect the document S and a window 35 facing an image reading device (not shown) are provided.

The feeding roller 27 is supported at the receiving port 21 in a rotatable manner. When the document S is placed on the document placement part 11 of the document table 3 and then the lift plate 13 is turned upwardly as described above, the leading end portion of the document S placed on the document placement part 11 is lifted and comes into contact with the feeding roller 27. Then, when the feeding roller 27 is rotated, the document S placed on the document placement part 11 is fed to the conveyance path 25.

The conveyance rollers pairs 29 are disposed between the receiving port 21 and the discharge port 23 along the conveyance path 25 at predetermined intervals. The conveyance rollers pairs 29 are rotated to convey the document S fed to the conveyance path 25 along the conveyance path 25.

The discharge rollers pair 31 is supported at the discharge port 23 in a rotatable manner. When the discharge rollers pair 31 is rotated, the document S conveyed along the conveyance path 25 is discharged to the discharge direction D (the right direction).

The discharge tray 7 has a document stacking part 41 (a sheet stacking part) on which the document S discharged through the discharge port 23 is stacked. The document stacking part 41 has an upright portion 41*a*, a flat portion 41*b* and an inclined portion 41*c*. The upright portion 41*a* is bent obliquely downward from the discharge port 23 toward the downstream side in the discharge direction D with respect to the vertical direction. The flat portion 41*b* is formed to be almost horizontally toward the downstream side from the lower end of the upright portion 41*a*. The inclined portion 41*c* is inclined upwardly from the flat portion 41*b* toward the downstream side.

On the center portions of the flat portion 41*b* and the inclined portion 41*c* in the width direction, a pair of grooves 43 is formed along the discharge direction D. In the grooves 43, sheet metal pieces 45 (45A to 45E) as a fixed magnetic body are embedded at predetermined positions. The predetermined positions (the positions in which the sheet metal pieces 45A to 45E are embedded) correspond to the respective positions of the leading edges (the downstream side edges in the discharge direction D) of the documents S of a postcard size, a laterally long B5 size sheet, a laterally long A4 size sheet, a longitudinally long B5 size sheet and a longitudinally long A4 size sheet when they are stacked on the document stacking part 41. In detail, each predetermined position corresponds to the leading edges of the documents S having respective size from the upright portion 41*a*. On each position, a mark showing a size of the corresponding document S is marked.

Figure 4A:
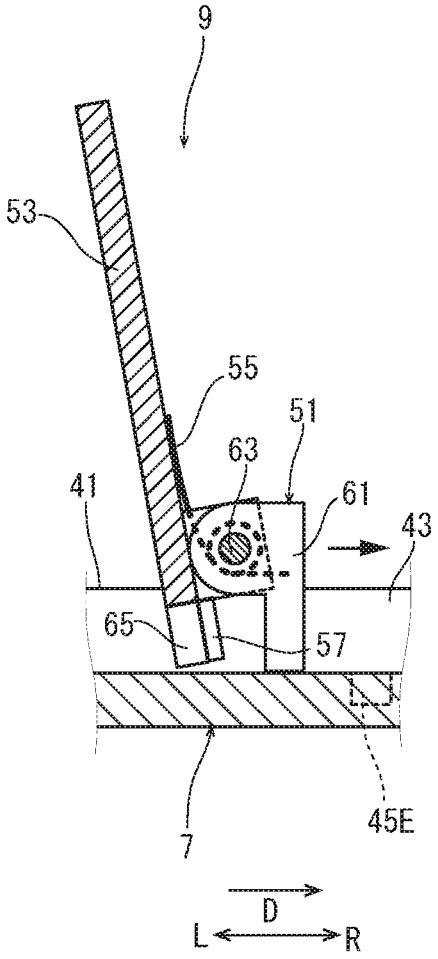
FIG. 4A is a cross sectional view along a III-III line in FIG. 3, showing a stopper moved in a position other than a predetermined position, in the document feeding device according to the embodiment of the present disclosure.
Figure 4B:
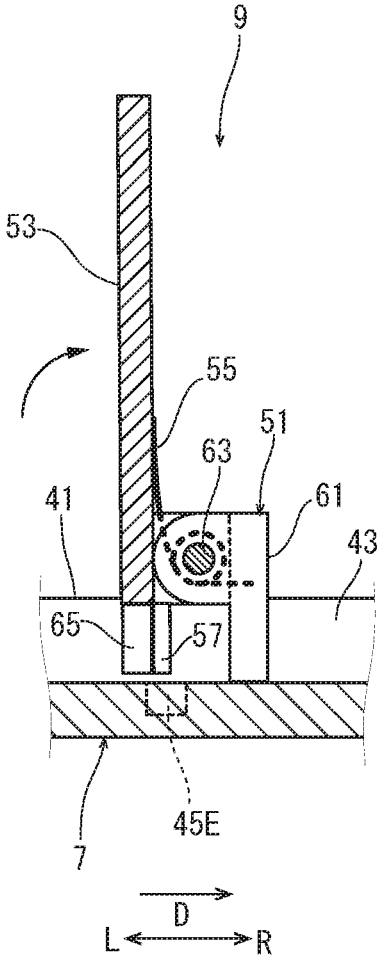
FIG. 4B is a cross sectional view along a III-III line in FIG. 3, showing the stopper moved in a predetermined position, in the document feeding device according to the embodiment of the present disclosure.

Next, the stopper 9 will be described with reference to FIG. 4A and FIG. 4B, in addition to FIG. 2 and FIG. 3. FIG. 4A and FIG. 4B are sectional views along a III-III line in FIG. 3.

With reference to FIG. 3, FIG. 4A and FIG. 4B, the stopper 9 includes a guide body 51, a contact piece 53, a coil spring 55 as a biasing member and two magnets 57 as a moving magnetic body.

The guide body 51 has a pair of guide pieces 61 disposed at an interval equal to a distance between the grooves 43 of the discharge tray 7 and a turning shaft 63 connecting the guide pieces 61. The guide pieces 61 are engaged with the grooves 43 in a slidable manner.

The contact piece 53 is formed into a rectangular plate long in the width direction, and has a width longer than a distance between the grooves 43 of the discharge tray 7. As shown in FIG. 4A and FIG. 4B, on the lower edge of the contact piece 53, a pair of legs 65 is formed. The legs 65 are separated at an interval equal to a distance between the grooves 43. The lower end portion (the portion above the legs 65) of one face (the downstream side face) of the contact piece 53 is supported by the turning shaft 63 of the guide body 51 in a turnable manner.

The coil spring 55 has a coil portion, a first arm portion and a second arm portion. The coil portion is fitted around the turning shaft 63 of the guide body 51, the first arm portion is fixed to one of the guide pieces 61 and the second arm portion is fixed to the contact piece 53. The coil spring 55 biases the contact piece 53 to turn to a side of the guide body 51 around the turning shaft 63. When the coil spring is in a natural state (no load is applied to the arm portions), as shown in FIG. 4A, the contact piece 53 is kept in an inclined posture by the coil spring 55. In the inclined posture, the contact piece 53 is slightly inclined with respect to a perpendicular posture (the contact piece 53 is slightly inclined to a direction opposite to the guide body 51).

The two magnets 57 are attached to the respective legs 65. The magnet 57 may be attached to the lower face or the side face of the leg 65. Alternatively, the magnet 57 may be embedded in the leg 65.

The stopper 9 is attached to the discharge tray 7 by engaging the guide pieces 61 of the guide body 51 with the grooves 43 in a posture where the guide body 51 faces downstream and the contact piece 53 faces upstream in the discharge direction D. The guide pieces 61 are prevented from being removed from the grooves 43. In the state, because no load is applied to the arm portions of the coil spring 55, the contact piece 53 is kept in the inclined posture by the coil spring 55 (refer to FIG. 4A). The legs 65 of the contact piece 53 are inserted into the grooves 43.

An operation of the stopper 9 having the above configuration will be described. Firstly, a document S (for example, a longitudinal long A4 size) is placed on the document placement part 11 of the document table 3, and then aligned by the side cursors 15 in the width direction. Then, the stopper 9 is made to be slid to a position where the mark corresponding to a size of the document is marked (the position where the sheet metal piece 45E is embedded). In detail, the guide body 51 of the stopper 9 is slid along the grooves 43. When the guide body 51 is close to the corresponding position, a magnetic field is generated between the magnet 57 provided in the contact piece 53 and the sheet metal piece 45E embedded in the groove 43 such that the magnet 57 and the sheet metal piece 45E are attracted each other. Then, when the stopper 9 is slid to a position where the strongest magnetic field is generated, the magnet 57 is attracted to the sheet metal piece 45E, and a resistance is applied to the sliding of the stopper 9 by the magnetic field between them. Additionally, as shown in FIG. 4B, the contact piece 53 is stood from the inclined posture to the perpendicular posture.

In such a manner, when a resistance is applied to the sliding of the stopper 9 and it is recognized that the contact piece 53 is stood in the perpendicular posture, the sliding of the stopper 9 is stopped. In the present embodiment, as shown in FIG. 4B, because the sheet metal piece 45E is shifted from the contact piece 53 in the discharge direction D, the sheet metal pieces 45A to 45E are positioned on a basis of the position of the contact piece 53 (the upstream side face with which the document S comes into contact actually).

After that, the reading of the document S is started. Firstly, the lift plate 13 of the document placement part 11 is turned upwardly, and the leading end portion of the document S placed on the lift plate 13 comes into contact with the feeding roller 27. Then, the feeding roller 27 is rotated to feed the document S to the conveyance path 25. The document S is conveyed by the conveyance rollers pairs 29 along the conveyance path 25. When the document S reaches the window 35, the image of the document S is read by the document reading device. Then, the document is discharged by the discharge rollers pair 31. The leading edge of the discharged document S comes into contact with the contact piece 53 of the stopper 9, and then the document S falls down and is stacked on the document stacking part 41. The stopper 9 is kept at the stopped position by the magnetic force so that it is hardly displaced when the document S comes into contact with the contact piece 53. Furthermore, the contact piece 53 is kept with the perpendicular posture by the magnetic force so that it is hardly turned when the document S comes into contact with the contact piece 53.

After the reading of all the documents S is completed, the documents S stacked on the document stacking part 41 of the discharge tray 7 is taken out. At this time, when the documents S are taken out downstream in the discharge direction D (rightward in FIG. 2, FIG. 4A and FIG. 4B), the contact piece 53 is turned downstream against a biasing force of the coil spring 55 so that the stopper 9 does not inhibit the documents from taking out of the document stacking part 41. After the documents S are taken out, the contact piece 53 is returned to the perpendicular posture or the inclined posture by the biasing force of the coil spring 55.

When the next document S of the different size is read, the stopper 9 is moved against the magnetic force between the magnet 57 and the sheet metal piece 45E, and slid to a position with the mark corresponding to a size of the next document S.

As described above, according to the document feeding device 1 of the present disclosure, because the stopper 9 can be kept at a position corresponding to a size of the document S, it becomes possible to enhance an alignment of the read documents S. Additionally, the stopper 9 can be slid along the flat portion 41*b* and the inclined portion 41*c* of the document stacking part 41 of the discharge tray 7 so that it can be applied to various shapes of the discharge tray 7.

More specifically, when the stopper 9 is slid to a suitable position, a resistance to the sliding movement of the stopper 9 is transmitted to the finger, so that it becomes possible for the user to know the stopped position of the stopper 9 by tactile sense. Additionally, at the stopped position of the stopper 9, the contact piece 53 is turned from the inclined posture to the perpendicular posture so that it becomes possible for the user to recognize the stopped position visually. As described above, the contact piece 53 is kept in the inclined posture other than the perpendicular posture at a position other than the stopped position so that it becomes possible to recognize the change in posture of the contact piece 53 visually. However, the contact piece 53 may be kept in almost a perpendicular posture instead of the inclined posture, at a position other than the stopped position.

Furthermore, because the contact piece 53 is turned downstream when the documents S are taken out and returns to the original posture after the documents S are taken out, it becomes possible to improve the workability for taking out the document S.

However, the contact piece 53 need not necessarily be provided in a rotatable manner, and may be supported by the guide body 51 with the perpendicular posture. Alternatively, the contact piece 53 may be supported in a rotatable manner around the turning shaft 63 without using the coil spring 55. In this case, when the stopper 9 is used, the contact piece 53 is turned to the perpendicular posture with which the leading edge of the document S comes into contact, and when the stopper 9 is not used, the contact piece 53 is turned in a retracting posture where it is retracted into the document stacking part 41. In these cases, the magnet 57 may be mounted to the guide pieces 61.

Figure 5:
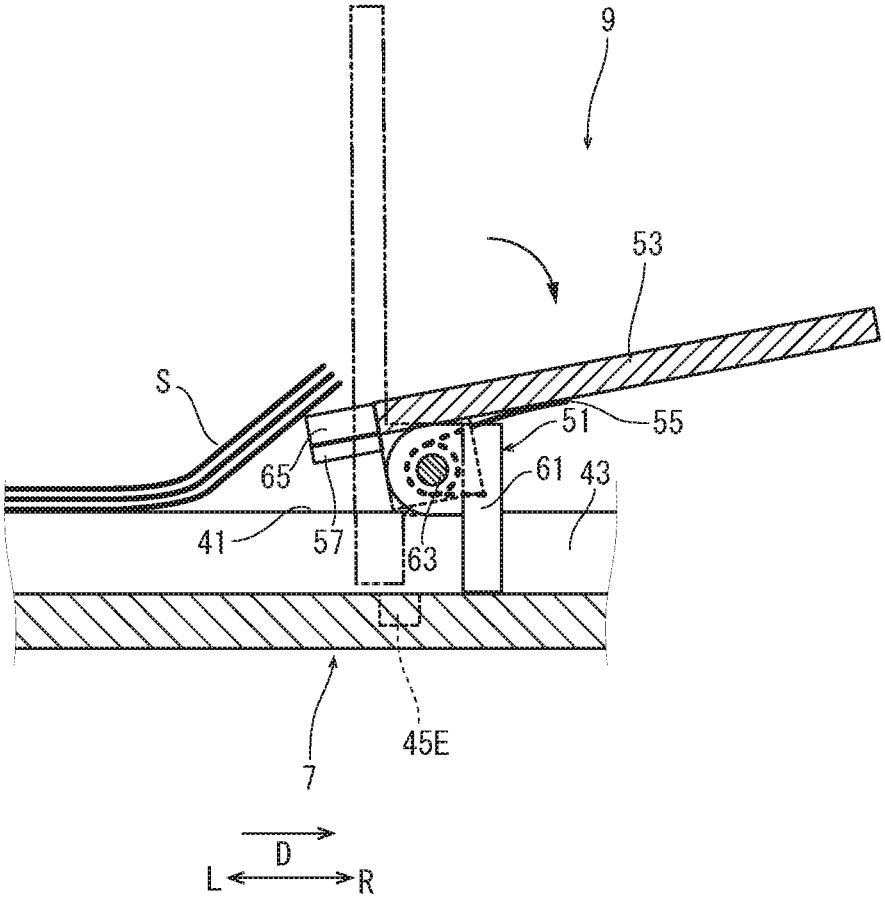
FIG. 5 is a side view showing the leading end portion of the document picked up by turning a contact piece, in the document feeding device according to the embodiment of the present disclosure.

Furthermore, as shown in FIG. 5, when the contact piece 53 is turned downstream at taking out the documents S, the legs 65 of the contact piece 53 are separated upward from the grooves 43 and lifts up the document S. Then, by picking up the leading end portions of the documents S with his fingers, it becomes more easier to take out the documents S.

The upper portion or the whole of the contact piece 53 may be made of flexible material (for example, rubber). In this case, the contact piece 53 is deformed at taking out the documents S, so that it becomes more easier to take out the documents S. In addition, the impact generated when the document S comes into contact with the contact piece 53 is absorbed so that the noise can be reduced.

Furthermore, because the sheet metal pieces 45A to 45E are used as the fixed magnetic body provided in the grooves 43 and the magnet 57 is used as the moving magnetic body provided in the stopper 9, both the magnetic bodies can be made inexpensively. However, both the magnetic bodies may be made of magnets which generates magnetic forces that attracts each other.

The sheet feeding device 1 of the present disclosure may be used as a discharge device which discharges the sheet on which an image is formed or subjected to a post-processing.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A sheet discharge device comprising:

a discharge member which discharges a sheet in a predetermined discharge direction;

a discharge tray on which the sheet discharged by the discharge member is stacked; and a stopper which regulates a leading edge of the sheet stacked on the discharge tray, wherein the discharge tray includes:

a groove formed along the discharge direction; and a fixed magnetic body disposed at a predetermined position along the groove, the stopper includes:

a guide piece engaged with the groove in a slidable manner;

a contact piece with which the leading edge of the sheet discharged by the discharge member is allowed to be come into contact; and a moving magnetic body which generates a magnetic force in a direction in which the moving magnetic body and the fixed magnetic body are attracted each other; wherein when the guide piece is slid along the groove and the moving magnetic body reaches the predetermined position, a resistance is applied to a sliding movement of the guide piece by the magnetic force generated between the fixed magnetic body and the moving magnetic body.

2. The sheet discharge device according to claim 1, wherein the stopper includes:

a turning shaft provided in the guide piece and supporting the contact piece in a turnable manner; and a biasing member biasing the contact piece to turn upstream in the discharge direction and to support the contact piece in a predetermined posture with respect to the guide piece.

3. The sheet discharge device according to claim 2, wherein the moving magnetic piece is provided in the contact piece, and the predetermined posture is an inclined posture other than a perpendicular posture, wherein when the guide piece is slid along the groove and the moving magnetic body reaches the predetermined position, the contact piece is turned from the inclined posture to the perpendicular posture by the magnetic force generated between the moving magnetic body and the fixed magnetic body.

4. The sheet discharge device according to claim 2, wherein the contact piece has a leg which is inserted in the groove, and when the contact piece is turned downstream in the discharge direction in a state where the leading edge of the sheet comes into contact with the contact piece, a leading end portion of the sheet is picked up by the leg.

5. The sheet discharge device according to claim 1, wherein the fixed magnetic body is a sheet metal piece, and the moving magnetic body is a magnet.

6. The sheet discharge device according to claim 1, wherein at least an upper portion of the contact piece is made of flexible material.

7. The sheet discharge device according to claim 1, wherein the discharge tray has a sheet stacking part, the sheet stacking part has an inclined portion inclined upwardly toward the downstream side in the discharge direction, and the groove is one of two parallel grooves formed in the sheet stacking part along the discharge direction.

* * * * *